United States Patent [19]

Van der Meulen

[11] 4,214,509

[45] Jul. 29, 1980

[54] METHOD AND APPARATUS FOR MANUFACTURING BAGS OF A CONTINUOUS WEB OF A THERMOPLASTIC SYNTHETIC SHEET MATERIAL

[76] Inventor: Leonard Van der Meulen, Immeuble Saadi El Menzah, Appt. 22a, 6ième Etage, Tour A, Tunis, Tunisia

[21] Appl. No.: 909,578

[22] Filed: May 25, 1978

[30] Foreign Application Priority Data

May 31, 1977 [NL] Netherlands ..... 7705977

[51] Int. Cl.[2] ..... B31B 1/64; B31B 27/60

[52] U.S. Cl. ..... 93/35 R; 93/33 H; 156/290; 156/253; 156/510; 156/583.1

[58] Field of Search ..... 156/290, 252, 253, 510, 156/583; 53/548, 550; 93/DIG. 1, 33 H, 35 R, 8 R

[56] References Cited

U.S. PATENT DOCUMENTS

| | | | |
|---|---|---|---|
| 2,720,246 | 10/1955 | Piazze | 93/DIG. 1 |
| 3,004,881 | 10/1961 | Van der Meulen | 156/253 |
| 3,223,027 | 12/1965 | Soda et al. | 156/583 X |
| 3,379,101 | 4/1968 | Piazze | 93/33 H UX |
| 3,419,453 | 12/1968 | Levenson, Jr. | 156/583 X |
| 3,666,611 | 5/1972 | Joa | 156/290 X |
| 3,901,754 | 8/1975 | Simpson et al. | 93/33 H X |
| 3,971,299 | 7/1976 | Whittle et al. | 93/33 H |
| 4,061,458 | 12/1977 | Windmoller et al. | 425/392 |

*Primary Examiner*—James F. Coan

*Attorney, Agent, or Firm*—Lerner, David, Littenberg & Samuel

[57] ABSTRACT

A method and apparatus for making bags from a thin thermoplastic material supplied as either a flat tube or a double-folded web to an advancing supporting path such as the common opposite flights of two sets of endless conveyors, thereby applying the loop-system principle, the supporting conveyors clamping the material at spaced intervals with two sets of clamping beams, lying close to each other, a separate set of cooperating sealing beams cooperating with the thermoplastic material for making the seals within the space between both sets of clamping beams.

42 Claims, 6 Drawing Figures

A
B

METHOD AND APPARATUS FOR MANUFACTURING BAGS OF A CONTINUOUS WEB OF A THERMOPLASTIC SYNTHETIC SHEET MATERIAL

BACKGROUND OF THE INVENTION

The invention relates to a method of manufacturing bags from an initial tubular or half-tubular web of synthetic sheet material while applying the principle of the formation of loops. In a path of treatment the web is clamped at regular distances between a pair of beams or bars travelling in two separate circuits at a velocity being lower than the velocity of supply whereas the web is heatsealed and transversely perforated near the clamping zone.

According to this method the clamping beams are at the same time the sealing beams which causes the presence of a great number of these combined clamping- and sealing beams to be provided, said combined beams carrying the web of sheet material along the entire treatment path for obtaining the required welding and cooling of the seals. In this specification the word "seal" is used for the joint, or weld or seam obtained by the sealing beams. To exercise heat and pressure upon the superimposed layers of the thermoplastic material of the web does not suffice. The said seals only obtain their strength after a sufficient cooling. It was imperative to perform a heating of the combined clamping and sealing beams only in the first portion of the treatment path. In the last portion of said path the heating should be interrupted, in order to allow the seals to cool down.

DISCUSSION OF THE PRIOR ART

In the prior art method as disclosed in French Pat. Specifications Nos. 1.160.010 and 1.112.968.

The presence of a great number of combined clamping and sealing beams travelling along the entire treatment path, caused a considerable technical complication. It was further difficult to heat the combined beams only in a first portion of the treatment path and to let these beams cool down in the remaining (last) portion of the treatment path such that the seals in the web, which remained in contact with the combined beams, could sufficiently cool down. The exact control of the heating time and the cooling period for the combined beams is difficult, especially as these times are dependent upon the kind of thermoplastic synthetic material and upon the thickness of the sheet of material. A further drawback of these known methods consists in that the combined beams do not cool down rapidly whilst the continuous contact between these beams and the seals in the web hamper a cooling and shrinking of the seals.

In the prior art methods the double ply web is first sealed in transverse direction. After leaving the sealing station, the web is provided with a perforation in a zone lying near the seal. In this respect the German Patent 2,530,636 shows a method without using the system with loop formation, in which the transverse sealing of a double ply web of synthetic sheet material is performed by combined sealing and perforation member, embodied as beams mounted in travelling endless chains, said beams cooperating pairwise for clamping and conveying the web.

In the prior art the seal beams and the clamping beams form a structural unit which are guided along a common travelling path such that the number of seal beams correspond to the number of clamping beams cooperating there with.

SUMMARY OF THE INVENTION

The present invention aims at manufacturing a number of cohering bags interconnected to each other via a perforated zone. In praxis that is called a clain of bags which can be wound to a smaller or bigger reel. These reels or rolls can be used either households, or in shops. Housewives or shopkeepers should be able to tear off each bag without the risk of damaging the seal. It is also possible, which is recommendable with big bags, to tear off each bag immediately after the completion of its manufacture.

During the manufacture of bag chains difficulties may occur. It is sometimes necessary to produce bags with different lengths or bags having either a seal at the bottom or a seal at both sides. In both cases a guarantee must be obtained that after having chosen the correct length or width of the bags, this dimension remains the same during the entire manufacturing operation. It is further desirable that the perforation lies near the seal and that this seal is sufficiently cooled down at the moment when the web leaves the manufacturing machine. This latter requirement is imperative for pulling the web out of the machine and to reel up the bag chain under some tension.

The present invention starts from the conception that for the manufacture of a bag chain, especially in a method using the loop-formation principle, it must be possible to manufacture bags either with a bottom seal or a side weld without many complications while further the distance between the perforation and the seal can be adjusted, and in which the sealing operation takes place under a slack condition of the web. Furthermore the seal should be able to cool down in a tension free condition.

These objects are obtained in the method according to the invention in that at the beginning of the path of treatment each time two pairs of clamping beams contact the web at a short interval after each other, the velocity of supply of the web being controlled accurately in the time between said two contact moments, and in that heat sealing the web is carried out by two separate circuits within the path of treatment, but beyond the location where the web is perforated, the clamping beams continuing their cooperation with the web beyond the heat sealing circuits for cooling purposes.

According to the invention the means for clamping and for sealing the web consist of separate elements which are guided in separate circuits which cooperate with each other only in a portion of the treatment path. This produces the following properties and advantages:

(a) Due to the removal of the sealing means from the clamping means after the sealing operation, the web is only hold by the clamping means so that the seal between both cooperating pairs of clamping beams can cool down unhampered.

(b) After the removal of the sealing means it is possible to exercise an additional cooling action upon the seal which is lying free between both pairs of cooperating clamping beams, which additional cooling can be performed by a jet of air or by means of separate clamping beams circulating in a separate circuit in the same manner as the sealing beams.

(c) The number of sealing members is smaller than the number of clamping members which means a simplification of the structure of the machine.

(d) The circuit in which the sealing members are travelling is shorter than the path of the clamping means.

(e) The electrical heating of the sealing means can be constant over the entire travelling path of said means.

(f) The short path of the sealing means simplifies the electrical installation for heating the sealing beams.

(g) The lapse of time during which the sealing means act upon the web can be changed by relative simple means.

(h) The perforation of the web can be performed between the cooperating pairs of clamping beams prior to the trasverse sealing operation.

(i) In consequence of the fact that the perforation- and sealing operation is synchronized with the clamping of the web of synthetic sheet material, it is now possible without any danger for a relative position between the perforation and the seal, to change the length (or the width) of the bags in a stepless manner by increasing or diminishing the length of the loops.

(k) Due to the distance between two pairs of adjacent clamping beams, sealing or can now be performed simultaneously from the lower and the upper side of the web.

The invention is also embodied in an apparatus for carrying out the above mentioned method. Said apparatus comprises a supply of a web of synthetic sheet material to a treatment path, formed by two endless circuits provided with elements which cooperate pairwise in the path of treatment for clamping the web and means for heat sealing and for perforating the web at regular distances (equidistantly). This apparatus which is also known from both above mentioned French Patent Specifications is distinguished according to the invention in that:

-the clamping elements of each circuit consists each time of two beams or bars located close to each other which at the beginning of the path of treatment enter into cooperation with the web within a short time interval, -the supply of the web comprises means for accurately controlling the feed velocity of the web during the lapse of time between entering into operation of the clamping beams, -the devices for perforating the web are arranged at the beginning of the path of treatment, and -the heat sealing means consist of two cooperating circuits with sealing beams which circuits only travel through a part of the path of treatment of the clamping beams.

In further embodiments the means for accurately controlling the velocity of the web during the lapse of time between entering into operation of the clamping beams, may consist of a pair of rollers cooperating with the web, one of said rollers being provided with a segment having a greater radius than the radius of the rest of this roller, the driving means of these rollers being coupled to the driving means of the circuits for the clamping beams.

The means for feeding the web towards the apparatus may comprise two pairs of rollers, one pair lying ahead of the just mentioned segmented roller, the other pair lying beyond said roller, said last mentioned pair of rollers allowing a slip of the web in the lapse of time during which the segment controls the speed of the web.

DESCRIPTION OF TWO EMBODIMENTS

Figure 1:
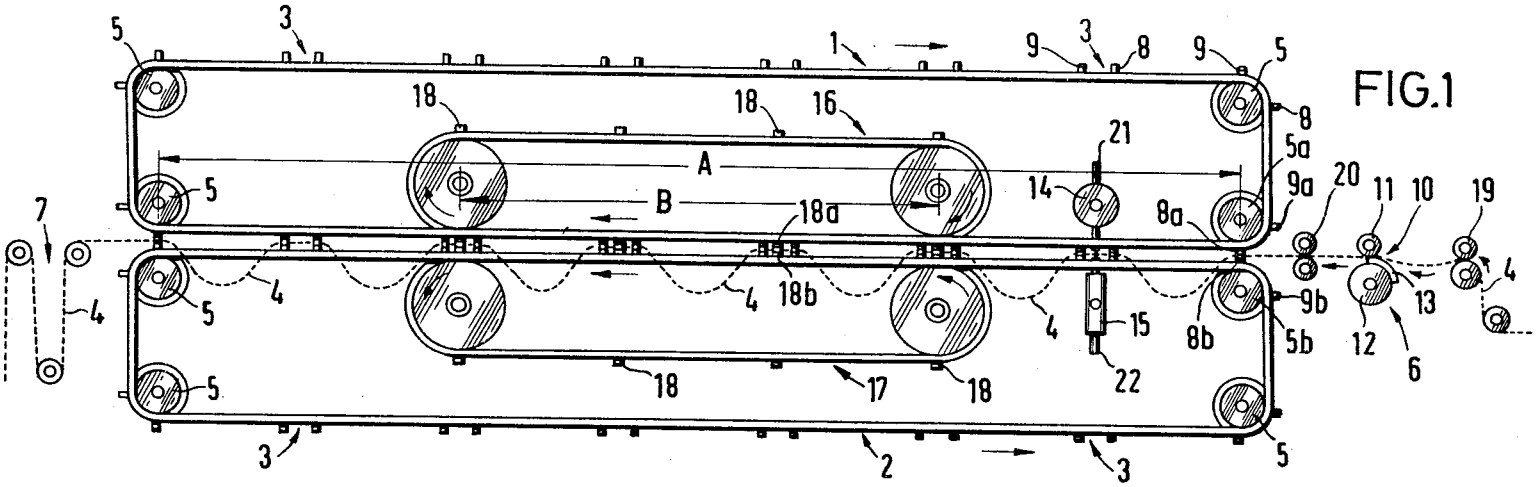
FIG. 1 shows a section according to a vertical plane through the apparatus.
Figure 2:
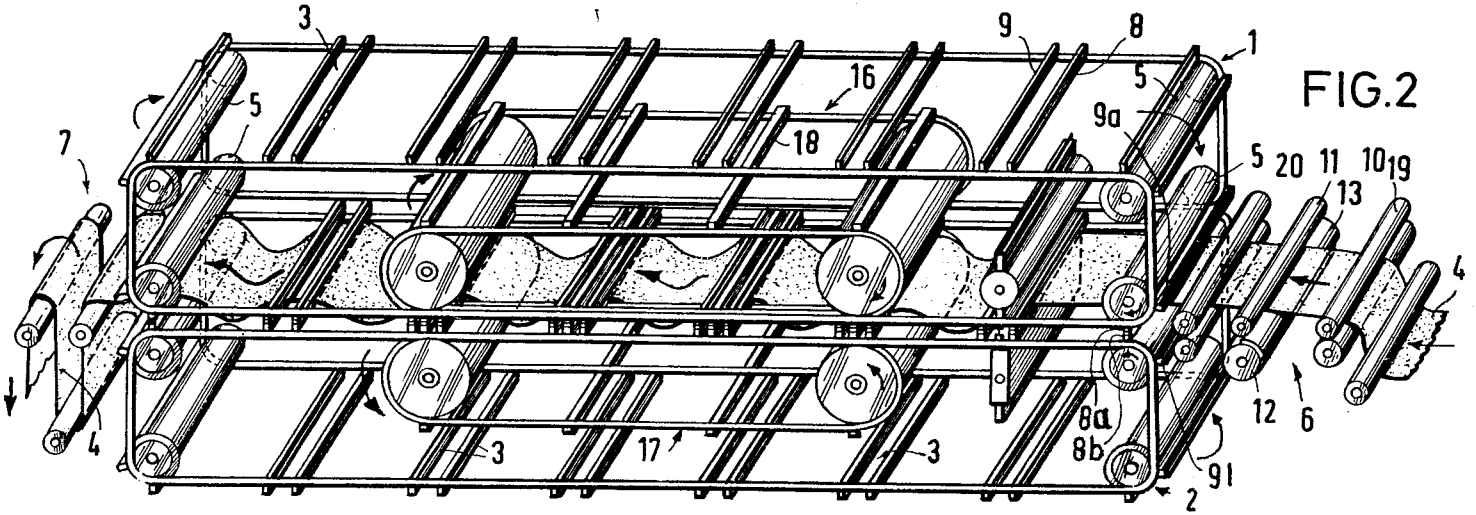
FIG. 2 gives a perspective view of the apparatus of FIG. 1.

Firstly, the basic principles will be explained with reference to FIG. 1. The apparatus includes two endless bands or chains 1 and 2 which each travel in a closed circuit in a direction indicated by an arrow. Said chains comprise clamping elements 3 mounted thereon at regular intervals (equidistantly). The oppositely disposed flights of the cooperating circuits 1 and 2 form a treatment path or stretch A in which the respective elements 3 cooperate with each other for clamping and conveying a web 4 of synthetic thermoplastic sheet material. The circuits 1 and 2 comprise four guide rollers 5 giving both circuits a substantially rectangular configuration, in which the treatment path A consists of a rectilinear stretch lying in a horizontal plane. Ahead of this treatment path A supply means 6 are provided, just in front of the guide rollers 5*a* and 5*b*. The web 4 may either be a flat tube or a half tube, the latter consisting of a double folded strip. Beyond the treatment path A, the apparatus comprises discharge means 7 shown at the left-hand side of FIG. 1. From these means 7, the web 4 is further conveyed towards a winding apparatus or reel.

As clearly appears from FIG. 1, the so-called loop-forming principle is employed that is to say that the rate of travel of the chains 1, 2 with the clamping elements 3 is less than that of the web 4 by the supply means 6.

Each clamping element 3 of the circuits 1, 2 consists of two beams or bars 8, 9 positioned close to each another. At the beginning of the treatment path A (right-hand side of FIG. 1) the beams 8 and 9 moving along the guide rollers 5*a* and 5*b* will enter into cooperation with the web 4 within a short time interval. As can be seen in FIG. 1 the opposite clamping beams 8*a* and 8*b* near the guide rollers 5*a* and 5*b* already engage the web 4 at both sides. The beams 9*a* and 9*b* are still remote from the web 4. This time interval between the moment at which the beams, 8*a*, 8*b* have already gripped the web 4 at both sides and the moment at which the web will also be gripped by the bars 9*a* and 9*b*, is used for accurately controlling the velocity of the web 4, such that a small surplus of material becomes available in between the two pairs of cooperating clamping beams 8 and 9. For this purpose the supply means 6 include control means 10 which will be described in greater detail with reference to FIG. 5.

The means 10 consisting of two rollers 11 and 12 cooperating with the web 4 are coupled with the circuits 1, 2 in order to have a synchronous speed. Roller 12 is provided with a segment 13 having a radius larger than the remainder of this roller. The duration of cooperation between the upper roller 11 on the one hand and the segment 13 of the lower roller 12 on the other hand is identical to the period of time between the engagement of the clamping beams 8a, 8b upon the web 4 and the engagement of the beams 9a, 9b with the web.

At the beginning of the treatment path A the apparatus further comprises a perforation means in order to apply a perforation of the web in a transverse direction, said perforation lying between both pairs of clamping beams 8, 9. FIG. 1 shows a rotating roller 14 provided with two perforation knives arranged diametrically opposite each other, said knives cooperating with revolving anvils 15.

The apparatus is further provided with means for heat sealing or welding the web 4 at regular distances. These means comprise two cooperating circuits 16, 17 having beams 18. Said circuits 16, 17 cover only part of the treatment path A and travel in the same direction with the same speed. The sealing beams 18 are mounted on bands or chains.

The opposite flights of the circuits 16, 17 form a sealing path B in which the opposite sealing beams 18a and 18b cooperate with the web 4 for providing a transverse seal (joint) or weld. As may be seen from FIG. 1, the sealing path B is considerably shorter than the treatment path A in which the web is clamped and conveyed between the pairs of beams 8, 9. This means that the last portion of the treatment path is unengaged from the heated sealing beams 18, so that a cooling of the seal (joint) may take place. No forces will be exercised upon the hot and weak seal lying quietly between the pairs of clamping beams 8 and 9. The slight surplus of material of the web 4 lying between both pairs of clamping beams 8, 9 (determined by the segment 13 of the control means 10) is a guarantee for an unhampered shrinking possibility of the seal (or joint). The distance between both pairs of beams 8 and 9 is preferably about 8 cm.

Figure 6:
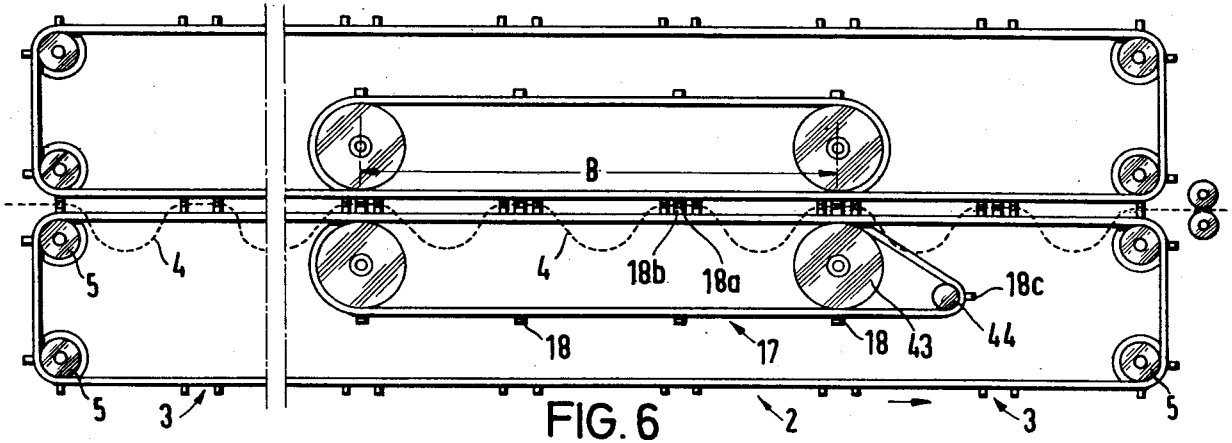
FIG. 6 is a view similar to FIGS. 1 and 3 of a further embodiment of the apparatus.

FIG. 6 shows that the treatment path A may be enlarged beyond the sealing path B. The standard machine as shown in FIG. 1 has a minimum cooling path which can be increased by additional elements comprising bearing for guide rollers 5 capable of cooperation with the circuits 1, 2 after an increase in length of the concerning chains. These additional chain portions also comprise clamping beams 3 corresponding in position and spacing to the other clamping beams.

Figure 4:
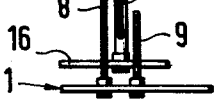
FIG. 4 is a top view of a small portion of the apparatus of FIG. 1.

As can be seen in FIG. 4, the clamping beams 8, 9 are longer than the heat sealing beams 18. Consequently the heatsealing circuits 16, 17 may fit within the clamping circuits 1, 2 in the treatment path A.

The loop-forming principle shown in FIG. 1 is decisive for the length or width of the bags to be manufactured, depending upon whether bags with a bottom seal or so-called side-weld bags have to be produced. Starting with a web 4 being a flat tube, each sealing beam 18 only needs one filament covered with TEFLON. Under these conditions the apparatus produces bags with a bottom seal.

When the web 4 consists of a so-called half-tube which may be formed by a double folded strip of thermoplastic material, each clamping beam 18 should comrise two spaced filaments with which two parallel seals may be manufactured simultaneously, the previously produced perforation lying exactly between both seals. In that case so-called side-weld bags are manufactured.

The length or width of each bag is determined by the length of the loops, which on its turn is determined by the ratio between the travelling speed of the circuits 1 and 2 on the one hand and the supply means 6 for the feeding speed of the web 4 on the other hand. This latter speed is determined by both roller pairs 19 and 20, as will be described in greater detail in connection with FIG. 5. The roller pair 20 does not exclude the possibility of a slip relative to the web 4.

Figure 5:
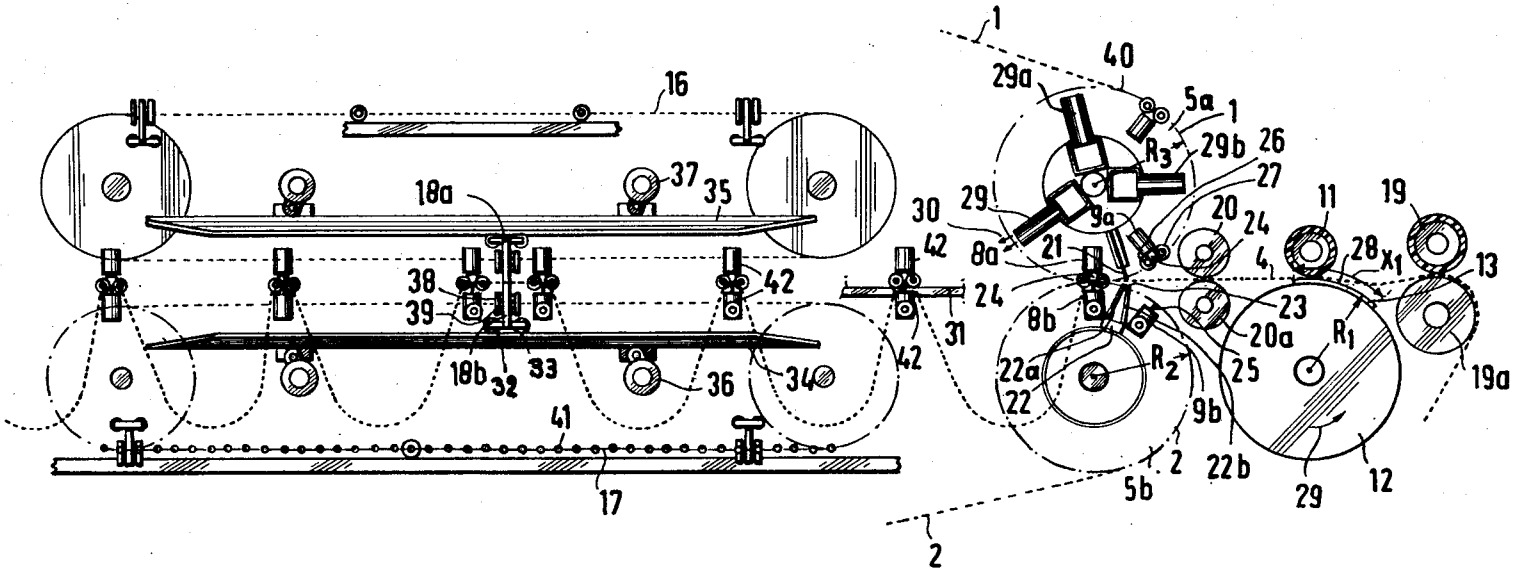
FIG. 5 gives a more detailed side elevational view on a somewhat larger scale of a portion of a further embodiment of the apparatus.

FIG. 5 shows that the perforating means 14, 15 are not mounted within the treatment path A as shown in FIG. 1, but just in the beginning of this path. The guide roller 5a at the beginning of the treatment path A is provided with a perforation knife 21 extending across the entire width of the web 4. The guide roller 5b comprises an anvil 22 embodied as two strips 22a and 22b forming a slit 23. The clamping beams 8a and 9a comprise rubber strips 24 whereas the clamping beams 8b and 9b comprise metal strips 25. On both sides of the rubber strips 24 and the metal strips 25 the concerning chains of the circuits 1 and 2 are provided with guiding wheels 26 and 27.

FIG. 5 further shows the moment at which the clamping beams 8a and 8b engage the web 4 by clamping this web between both beams. The roller pair 19 consists of an upper roller having a rubber cover and a lower roller 19a with a smooth metallic surface. The rotational velocity of both rollers 19, 19a surpasses the travelling speed of the circuits 1 and 2 carrying the beams 8, 9. At the moment of engagement of the beams 8a, 8b with the web 4, however, the segment 13 of the roller 12 enters into cooperation with the roller 11. The circumference 28 of the segment 13 has a radius $R_1$ corresponding with the radius $R_2$ respectively $R_3$ of the clamping faces of the beams 8 and 9 along the guide rollers 5a and 5b. The roller 12 rotates with a velocity corresponding to the circumferential speed of the rollers 5a and 5b. To this end, the roller 12 is coupled with the drive of the guide rollers 5a and/or 5b. The roller 11 cooperating with the segment 13 also has a rubber coating like the roller 19.

The segment 13 has an arc with a length of $X_1$ corresponding to the angular distance $X_2$ between the beams 8a and 9a respectively 8b and 9b. The arrangement is such that at the moment of engagement of the beams 8a and 8b with the web 4, the segment 13 enters into cooperation with the roller 11, thereby moving in the direction of the arrow 29. From this moment on the speed of the web 4 is equal to the speed of the circuits 1, 2 which means that there is hardly any difference between the feeding speed of the web and the travelling speed of the beams 8a, 8b. The web portion between the clamping beams 8a, 8b on the one hand and the roller pair 11 and 12, 13 on the other hand is kept mainly taut, enabling the knife 21 with the anvil 22, 23 to perforate the web 4 in transverse direction.

This rather taut condition of this portion of the web 4 is maintained as long as the segment 13 cooperates with the roller 11. The roller pair 20 is slipping. As soon as the segment 13 leaves the roller 11, the clamping beams 9a, 9b engage the web 4 which is no longer maintained in the taut condition caused by the segment 13. The portion of the web 4 which is now held between both pairs of clamping beams 8, 9 is slack which will have a favourable effect upon the subsequent sealing operation, taking place within the sealing path B.

During the time of cooperation of the segment 13 with the roller 11 a surplus length of the web 4 was supplied by the roller pair 19. As soon as the segment 13 has passed along the roller 11, the slip of the rollers 20 relative to the web 4 will cease, and the web will be feeded with a great velocity towards and beyond the guide rollers 5a and 5b. In this way a new loop is formed which will be taken up by the next pair of clamping beams 8, 9 so that this loop is entering into the treatment path A, vide FIG. 1.

In connection with the taut condition under which the web 4 is perforated by the means 21–23 and the somewhat slack condition of the web under which the sealing should take place, it is observed that the perforating operation causes some additional tension in the web portion, which tension is released as soon as the knife 21 leaves the anvil 22, 23, so that the web portion lying between both pairs of clamping beams 8, 9 is sufficiently slack to permit a correct sealing operation with subsequent shrinking of the seal.

The form of the bags can be easily changed and adapted due to the synchronization of the perforating means 14, 15 with the sealing means 18 and the circuits 1, 2 with the clamping beams 8, 9. Only a change in speed of the roller pairs 19 and 20 is required. By increasing the rotational speed of said rollers 19 and 20, the loops of the web 4 formed between subsequent pairs of clamping beams 8, 9 will be greater. This means that when the web 4 consists of a tube, the bags with a bottom seal will have a greater length. When the web consists of a half-tube, the width of the side-weld bags will increase. By reducing the rotational speed of the roller pairs 19 and 20 (thereby maintaining the original speed of the circuits 1 and 2 and 16, 17) the loops will become smaller, and the length or width, respectively of the bags will decrease. Such a very simple control of the form of the bags in a combined sealing-perforating-machine is novel and is of highly practical importance.

FIG. 5 further shows that the guide roller 5a comprises three air jets 29, 29a and 29b. The air stream is indicated with arrows 30 and serves to facilitate the loop formation. The rollers 26, 27 belonging to the clamping beams 8a and 9a are guided along the entire treatment path A over a guiding strip 31 which is only partly shown.

The sealing beams 18a and 18b are also provided with rollers 32 and 33 which are running along guide rail 34 and 35. The vertical position of these rails 34 and 35 can be adjusted by means of mountings 36 and 37. Thus, the sealing beams 18 can possibly be kept out of operation with the web 4 when required.

The sealing beams 18 are mounted at both ends in guides 38 which are secured to the pivots 41 of the chains 16 and 17. Rollers 39 are provided between the beams 18 and the guide 38. As already previously explained, the guide rail 34 and 35 render it possible to bring both sealing beams a firm contact with the web 4 in the sealing path B. The possibility of a vertical movement of the sealing beams 18 offers the following advantages:

(a) By means of the length of the guide rails 34 and 35, the duration of the sealing operation can be determined.

(b) During their inoperative condition, the sealing beams 18 will not protrude beyond the circuits 16, 17.

(c) The sealing beams can quietly take their position between both pair of clamping beams 8, 9 and will only enter into operation by means of the guide rails 34, 35.

When the method according to the invention is performed with a web consisting of a flat tube, a single seal between each pair of clamping beams 8, 9 suffices. This seal may be positioned either before or behind the perforation. This position of the seal is easily adjusted by a slight shifting of the phase between the circuits 16, 17 on the one hand and the circuits 1, 2 on the other hand. In this manner the distance between the perforation and the seal may be determined.

When the method is performed with a web composed of a half-tube, the sealing beams 18 should apply two seals simultaneously, one on each side of the perforation. This same kind of double sealing beam can also be used in the first mentioned method, provided one of the filaments is not heated and remains cool.

FIG. 5 shows a further additional feature consisting of some supporting clamping beams 42 lying between the clamping beams 3 (each consisting of two pairs 8, 9). The additional beams 42 are of the same structure as the beams 8 or 9 and only serve to support the loops at intermediate zones for limiting the debt of each loop. FIG. 5 shows that the loop between subsequent clamping elements 3 is divided by using two additional clamping beams 42 into three smaller loops.

FIG. 6 shows another feature in which the circuit 17 carrying the sealing beams 18b is guided along the small roller 44 lying near the guide roller 43. This means an increase in length of the chain 17 so that one additional clamping beam 18c is added to this chain. From this it follows that in the embodiment shown in FIG. 6, the upper circuit 16 comprises eight sealing beams 18a and the lower circuit 17 nine sealing beams 18b and 18c. This additional roller 44 will present the lower sealing beams 18b and 18c to enter into contact with the loops of the web 4 pending between subsequent pairs of clamping beams 8 and 9.

Figure 3:
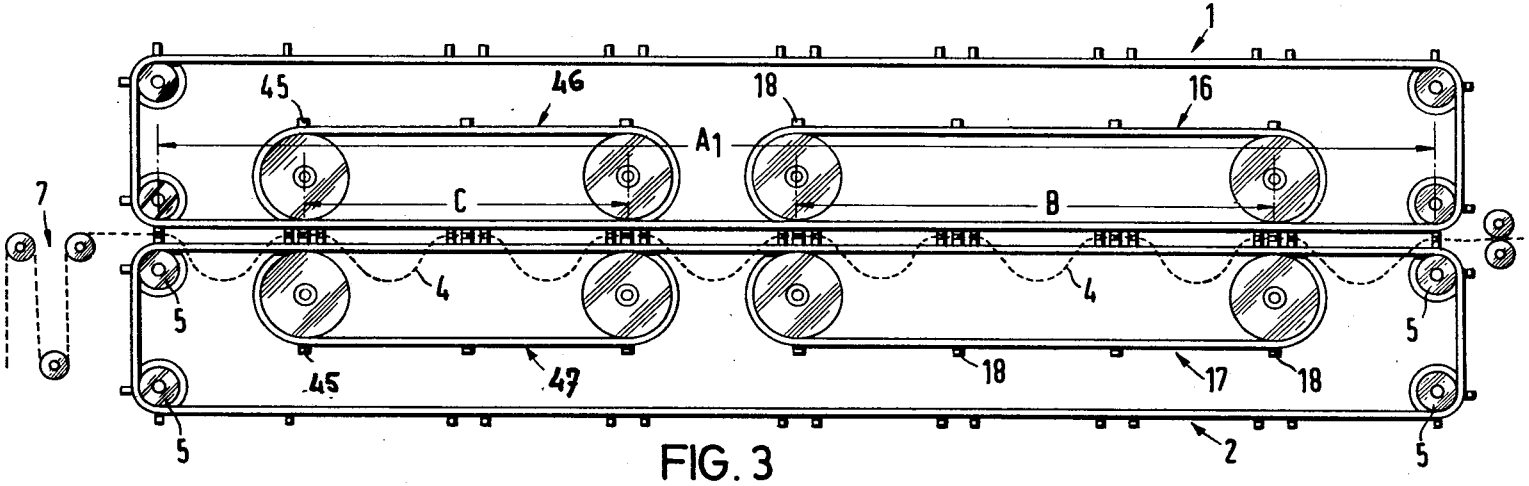
FIG. 3 is a picture mainly identical to FIG. 1, in which additional cooling members are provided.

In FIG. 3 an additional cooling path C is shown consisting of two circuits 46 and 47 carrying cooling beams 45. This path C is positioned beyond the sealing path B. The cooling beams 45 are positioned such that said beams will contact the seal produced in the preceding section B of the machine. The structure of the circuits 46, 47 is mainly identical to the circuits 16, 17. Besides the cooling beams 45, additional cooling means f.i. air jets may be provided such that the seals of the web 4 are sufficiently cooled down and strengthened when the web enters the discharge means 7.

I claim:

1. A method for the continuous manufacture of bags from a tubular web of synthetic sheet material comprising continuously supply said web to a bag producing zone at a first rate, clamping said web at regular intervals along its length at a clamping zone on said web at a point within said bag producing zone, said web being clamped between first and second pairs of clamping bars travelling along a pair of first paths juxtaposed on opposite sides of said web at a second rate, the relationship between said first rate and said second rate being such that tension in said web is avoided between said pairs of clamping bars, maintaining said web clamped between said pairs of clamping bars as said pairs of clamping bars travel along clamping path portions of said first paths parallel to said web, said clamping path portions having a first predetermined length, perforating said web at a first location on said web proximate to said clamping zone, and heat sealing said web at a second location on said web proximate to said clamping zone by contacting said web with heat sealing means travelling along a heat sealing path portion of a second path parallel to said web, said heat sealing path portion of said second path having a second predetermined length, said second predetermined length being less than said first predetermined length, so that said heat sealing path portion of said second path is contained entirely within and terminates before said clamping path portions of said first paths.

2. The method of claim 1 wherein said first and second locations proximate to said clamping zone are located between said clamping zone defined by said first and second pairs of clamping bars.

3. The method of claim 1, wherein said second location proximate to said clamping zone is located in said clamping zone between said first and second pairs of clamping bars.

4. A method for the continuous manufacture of bags from a tubular web of synthetic sheet material comprising continuously supplying said web to a bag producing zone, clamping said web at regular intervals along its length at a clamping zone on said web at a point within said bag producing zone, said web being clamped between first and second pairs of clamping bars travelling along a pair of first paths juxtaposed on opposite sides of said web, maintaining said web clamped between said pairs of clamping bars as said pairs of clamping bars travel along clamping path portions of said first paths parallel to said web, said clamping path portions having a first predetermined length, perforating said web at a first location on said web proximate to said clamping zone, and heat sealing said web at a second location on said web in said clamping zone between said first and second pairs of clamping bars by contacting said web with heat sealing means travelling along a heat sealing path portion of said path parallel to said web, said heat sealing path portion of said second path having a second predetermined length, said second predetermined length being less than said first predetermined length, so that said heat sealing path portion of said second path is contained entirely within and terminates before said clamping path portions of said first paths.

5. The method of claim 4, wherein said first location proximate to said clamping zone is located in said clamping zone between said first and second pairs of clamping bars.

6. The method of claim 4 including supplying said web to said bag producing zone at a controlled rate during the time that said web is clamped between said first pair of clamping bars and said second pair of clamping bars.

7. The method of claim 6 wherein said controlled rate is approximately equal to the rate at which said clamping bars and said heat sealing means travel along said first and second paths.

8. The method of claim 1 or 4 wherein said web is heat sealed by a pair of cooperating heat sealing means travelling along said heat sealing path portions of a pair of said second paths juxtaposed on opposite sides of said web.

9. The method of claim 1 or 4 wherein said web is supplied to said bag producing zone at a rate which is faster than the rate at which said clamping bars and said heat sealing means travel along said first and second paths, so that loops are formed in said web between said clamping zones.

10. The method of claim 1 or 4 including cooling said web at said second location proximate to said clamping zone at a location along said first paths subsequent to said termination of said second path.

11. The method of claim 10 wherein said cooling is carried out by means of an air current.

12. The method of claim 1 or 4 wherein said clamping path portions and said heat sealing path portion are substantially horizontal.

13. The method of claim 1 or 4 including maintaining said web under tension at said first location on said web during perforating of said web.

14. The method of claim 13 wherein said perforating of said web is carried out prior to said heat sealing of said web.

15. The method of claim 1 or 4 wherein said tubular web of synthetic sheet material comprises a half-tubular web thereof.

16. Apparatus for continuously manufacturing bags from a tubular web of synthetic sheet material comprising;

means for continuously feeding said web of synthetic sheet material to a bag producing zone at a feed velocity;

clamping means comprising a plurality of first and second pairs of clamping bars adapted to travel in first and second endless circuits juxtaposed on opposite sides of said web, said first and second endless circuits each including a first path portion parallel to said web so that when said first and second pairs of clamping bars travel in said first path portions said web is clamped between said clamping bars at a first web location throughout the length of said first path portions, said first and second endless circuits comprising endless bands of chains and including a plurality of guide rollers for driving said endless bands of chains, said plurality of guide rollers including a first guide roller for each of said first and second endless circuits, said first guide rollers being juxtaposed on opposite sides of said web at the start of said bag producing zone, perforating means for transversely perforating said web at a point proximate to said first web location; and heat sealing means comprising a plurality of heat sealing bars travelling in a third endless circuit including a second path portion parallel to said web, so that said web is heat sealed as said heat sealing bars contact said web throughout the length of said second path portion, said second path portion being shorter than said first path portions so that said second path portion is contained entirely within and terminates before said first path portions.

17. Apparatus for continuously manufacturing bags from a tubular web of synthetic sheet material comprising;

means for continuously feeding said web of synthetic sheet material to a bag producing zone at a feed velocity;

clamping means comprising a plurality of first and second pairs of clamping bars adapted to travel in first and second endless circuits juxtaposed on opposite sides of said web at a predetermined velocity, said first and second endless circuits each including a first path portion parallel to said web so that when said first and second pairs of clamping bars travel in said first path portions said web is clamped between said clamping bars at a first web location throughout the length of said first path portions, said means for continuously feeding said web including control means for accurately controlling the feed velocity of said web so that the feed velocity of said web can be adjusted to be at least equal to said predetermined velocity so that tension in said web can be avoided between said pairs of clamping bars;

perforating means for transversely perforating said web at a point proximate to said first web location; and heat sealing means comprising a plurality of heat sealing bars travelling in a third endless circuit including a second path portion parallel to said web, so that said web is heat sealed as said heat sealing bars contact said web throughout the length of said second path portion, said second path portion being shorter than said first path portions so that said second path portion is contained entirely within and terminates before said first path portions.

18. The apparatus of claim 17 wherein said heat sealing means include a plurality of first and second heat sealing bars travelling in third and fourth endless circuits juxtaposed on opposite sides of said web, said third and fourth endless circuits each including a second path portion parallel to said web so that when said first and second heat sealing bars travel in said second path portions said web is clamped and heat sealed between said heat sealing bars throughout the length of said second path portions.

19. The apparatus of claim 18 wherein said fourth endless circuit is longer than said third endless circuit.

20. The apparatus of claim 17 wherein said perforating means are located prior to said heat sealing means along said path of travel of said web.

21. The apparatus of claim 17 wherein said means for accurately controlling the feed velocity of said web comprises a first roller and a second roller juxtaposed on opposite sides of said web, said first roller including a first circumferential portion having a first roller radius and a second circumferential portion having a second roller radius, said first roller radius being greater than said second roller radius so that only said first circumferential portion of said first roller cooperates with said second roller to intermittently feed said web therebetween.

22. The apparatus of claim 21 including a third roller and a fourth roller juxtaposed on opposite sides of said web for feeding said web therebetween, said third and fourth rollers mounted for rotation at a velocity greater than the velocity of rotation of said first and second rollers in order to feed said web between said third and fourth rollers at a feed velocity greater than the feed velocity of said web with respect to said first and second rollers.

23. The apparatus of claim 17 wherein said endless circuits comprise endless chains, and including a plurality of guide rollers for driving said endless chains.

24. The apparatus of claim 23 wherein said means for accurately controlling the feed velocity of said web comprises a first roller and a second roller juxtaposed on opposite sides of said web said first roller including a first circumferential portion having a first roller radius and a second circumferential portion having a second roller radius, said first roller radius being greater than said second roller radius, so that only said first circumferential portion of said first roller cooperates with said second roller to intermittently feed said web therebetween.

25. The apparatus of claim 21 or 24 wherein each of said first and second pairs of clamping bars is separated by a predetermined distance, wherein the length of said first circumferential portion of said first roller comprises a second predetermined distance, and wherein said first predetermined distance is substantially equal to said second predetermined distance.

26. The apparatus of claim 24 including a third roller and a fourth roller juxtaposed on opposite sides of said web for feeding said web therebetween, said third and fourth rollers mounted for rotation at a velocity greater than the velocity of rotation of said first and second rollers in order to feed said web between said third and fourth rollers at a feed velocity greater than the feed velocity of said web with respect to said first and second rollers.

27. The apparatus of claim 26 including fifth and sixth rollers juxtaposed on opposite sides of said web for feeding said web material therebetween, said fifth and sixth rollers being located between said first and second rollers and said bag producing zone, said fifth and sixth rollers being mounted for rotation at a speed at least as great as the speed of rotation of said third and fourth rollers.

28. The apparatus of claim 24 wherein each of said guide rollers has a predetermined guide roller radius, and wherein said predetermined guide roller radius is substantially equal to said first roller radius.

29. The apparatus of claim 17 wherein said first and second endless circuits comprises endless bands or chains and including a plurality of guide rollers for driving said endless bands of chains, said plurality of guide rollers including a first guide rollers for each of said first and second endless circuits, said first guide rollers being juxtaposed on opposite sides of said web at the start of said bag producing zone.

30. The apparatus of claim 29 wherein said perforating means is mounted on said first guide roller of said first endless circuit.

31. The apparatus of claim 30 wherein said perforating means comprises knife means radially projecting from said first guide roller of said first endless circuit.

32. The apparatus of claim 31 wherein said first guide roller of said second endless circuit includes anvil means radially projecting therefrom whereby said knife means and said anvil means are adapted to cooperate in perforating said web disposed therebetween as said first guide rollers of said first and second endless circuits rotate with said web therebetween.

33. The apparatus of claim 32 wherein said anvil means includes slot means into which said knife means enters.

34. The apparatus of claim 33 wherein said first guide roller of said first endless circuit includes a plurality of radially projecting nozzle means for directing a stream of air onto said web as said web passes between said first guide rollers of said first and second endless circuits.

35. The apparatus of claim 17 wherein each of said heat sealing bars corresponds to one of said plurality of first and second pairs of clamping bars.

36. The apparatus of claim 35 including a plurality of secondary pairs of clamping bars travelling in said first and second endless circuits.

37. The apparatus of claim 17 wherein at least one of each of said first and second pairs of clamping bars includes guide roller means, and including a guide strip for cooperation with said guide roller means for guiding said clamping bars through said first path portions.

38. The apparatus of claim 17 wherein each of said heat sealing bars includes guides roller means, and including guide means disposed parallel to said web for guiding said heat sealing bars through said second path portion.

39. The apparatus of claim 17 wherein said heat sealing bars are moveable in a direction transverse to the direction of travel of said web.

40. The apparatus of claim 39 wherein said heat sealing bars are transversely moveable by means of holder means mounted on said first and second endless circuits and pressure means for permitting transverse movement of said heat sealing bars thereagainst.

41. The apparatus of claim 40 wherein said pressure means comprises leaf spring means.

42. The apparatus of claim 17 including cooling means for cooling said web at said second location proximate to said clamping at a point zone along said first paths subsequent to said termination of said second path portion.

* * * * *

UNITED STATES PATENT AND TRADEMARK OFFICE

CERTIFICATE OF CORRECTION

PATENT NO. : 4,214,509

DATED : July 29, 1980

INVENTOR(S) : Leonard Van der Meulen

It is certified that error appears in the above-identified patent and that said Letters Patent are hereby corrected as shown below:

Column 2, line 7, "that" should read --this--.
Column 2, line 7, "clain" should read --chain--.
Column 3, line 20, after "for a" insert --change in a--.
Column 3, line 25, after "sealing or" insert --welding operation--.
Column 4, line 41, "appears from" should read --shown in--.
Column 7, line 52, after "beams" insert --18 into--.
Column 8, line 48, "supply" should read --supplying--.
Column 9, line 32, "said" should read --a second--.
Column 12, line 38, after "30" insert --or 16--.

Signed and Sealed this

*Eleventh* Day of *November 1980*

[SEAL]

*Attest:*

SIDNEY A. DIAMOND

*Attesting Officer*

*Commissioner of Patents and Trademarks*